US010723577B2

(12) United States Patent
Brown et al.

(10) Patent No.: US 10,723,577 B2
(45) Date of Patent: Jul. 28, 2020

(54) SYSTEM AND METHOD OF AUTOMATIC FEEDER STACK MANAGEMENT

(71) Applicant: United States Postal Service, Washington, DC (US)

(72) Inventors: John W. Brown, Manassas, VA (US); Edward F. Houston, Bristow, VA (US); Juan A. Roman, Fairfax, VA (US); Leung M. Shiu, Gaithersburg, MD (US); Riley Houston Mayhall, III, Gaithersburg, MD (US); William P. McConnell, Woodstock, MD (US); Matthew G. Good, Marriottsville, MD (US); Robert E. Hume, Granite, MD (US); Thomas A. Hillerich, Jr., Louisville, KY (US); Long K. Ha, Frederick, MD (US)

(73) Assignee: United States Postal Service, Washington, DC (US)

( * ) Notice: Subject to any disclaimer, the term of this patent is extended or adjusted under 35 U.S.C. 154(b) by 0 days.

(21) Appl. No.: 16/026,652

(22) Filed: Jul. 3, 2018

(65) Prior Publication Data

US 2018/0312356 A1 Nov. 1, 2018

Related U.S. Application Data

(63) Continuation of application No. 15/154,603, filed on May 13, 2016, now Pat. No. 10,131,513, which is a (Continued)

(51) Int. Cl.

| | |
|---|---|
| ***B65H 3/62*** | (2006.01) |
| ***B65H 3/12*** | (2006.01) |
| ***B65H 1/02*** | (2006.01) |

(52) U.S. Cl.
CPC ..... *B65H 3/124* (2013.01); *B65H 1/025* (2013.01); *B65H 2511/214* (2013.01)

(58) Field of Classification Search
CPC ..... B65H 2220/02; B65H 2220/01; B65H 2515/34; B65H 1/025; B65H 2701/1916
(Continued)

(56) References Cited

U.S. PATENT DOCUMENTS 2,485,952 A 10/1949 Apgar et al.
3,126,201 A 3/1964 Rehm
(Continued)

FOREIGN PATENT DOCUMENTS

DE 196 12 567 A1 10/1997
DE 103 50 623 B3 4/2005
(Continued)

OTHER PUBLICATIONS

Written Opinion of the International Preliminary Examining Authority dated Jul. 7, 2015 for International Patent Application No. PCT/US14/23300.
(Continued)

*Primary Examiner* — Gregory W Adams
(74) *Attorney, Agent, or Firm* — Knobbe Martens Olson & Bear LLP

(57) ABSTRACT

Embodiments of a system and method for singulating articles in an automatic stack feeder are disclosed. The automatic stack feeder may comprise a pressure sensor on a perforated drive belt assembly configured to sense the pressure exerted by a stack of articles. The sensed pressure may be used to control various portions of the automatic stack feeder, such as a belt or a paddle.

17 Claims, 6 Drawing Sheets

Related U.S. Application Data continuation of application No. 13/797,291, filed on Mar. 12, 2013, now Pat. No. 9,340,377.

(58) Field of Classification Search
USPC ..... 271/19, 150, 153, 154, 155, 31.1; 414/795.2, 795.7
See application file for complete search history.

(56) References Cited

U.S. PATENT DOCUMENTS 3,485,488 A 12/1969 Ellison
3,504,909 A 4/1970 Burkhardt
3,649,002 A 3/1972 Burkhardt
3,817,516 A 6/1974 Lazzarotti et al.
3,854,613 A 12/1974 Renfrow
3,902,587 A 9/1975 Checcucci
3,988,017 A 10/1976 Kyhl
4,030,723 A 6/1977 Irvine et al.
4,163,550 A 8/1979 Armstrong
4,257,587 A 3/1981 Smith
4,579,501 A 4/1986 Fox
4,595,188 A 6/1986 Wiley et al.
4,653,741 A * 3/1987 Palmer ..... B65H 7/04 271/103
4,696,392 A 9/1987 Chisholm, Jr.
4,819,927 A 4/1989 Noguchi et al.
4,908,673 A 3/1990 Muramatsu
5,033,729 A 7/1991 Struthers
5,044,877 A 9/1991 Constant et al.
5,064,341 A 11/1991 Pippin
5,165,675 A 11/1992 Kanaya
5,246,223 A 9/1993 Ricciardi et al.
5,265,868 A 11/1993 Bowser et al.
5,271,710 A 12/1993 Decharran et al.
5,358,229 A 10/1994 Groel et al.
5,379,992 A 1/1995 Holmes et al.
5,391,051 A 2/1995 Sabatier et al.
5,407,317 A 4/1995 Pippin et al.
5,409,204 A 4/1995 Strohmeyer et al.
5,464,316 A 11/1995 Kranz
5,507,480 A 4/1996 Martin et al.
5,520,380 A 5/1996 Martin et al.
5,626,338 A 5/1997 Fattebert
5,630,697 A 5/1997 Black, Jr.
5,645,275 A 7/1997 Tranquilla
5,752,695 A 5/1998 Jehan et al.
5,755,437 A 5/1998 Ek
5,829,742 A * 11/1998 Rabindran ..... B65H 1/025 271/150
5,893,701 A 4/1999 Pruett
5,906,468 A 5/1999 Vander Syde et al.
5,908,191 A 6/1999 Chen et al.
5,934,866 A 8/1999 Redden
5,947,468 A 9/1999 McKee et al.
5,954,330 A 9/1999 Rabindran et al.
5,957,448 A 9/1999 Frank et al.
5,992,610 A 11/1999 Dufour et al.
6,003,857 A 12/1999 Salomon et al.
6,085,182 A 7/2000 Cordery
6,186,491 B1 * 2/2001 Tomiyama ..... B65H 1/025 271/10.03
6,217,020 B1 * 4/2001 Supron ..... B65H 1/025 271/149
6,270,070 B1 * 8/2001 Salomon ..... B65H 1/025 271/111
6,276,586 B1 8/2001 Yeo et al.
6,302,638 B1 10/2001 Eggebrecht
6,378,692 B1 4/2002 Cera et al.
6,402,134 B1 6/2002 Gauger et al.
6,494,446 B1 12/2002 Tomiyama et al.
6,503,044 B1 1/2003 Enekel
6,511,062 B1 * 1/2003 Blackwell ..... B65H 1/025 271/10.03
6,679,491 B2 1/2004 Luebben et al.
6,702,275 B2 3/2004 Niiyama et al.
6,715,755 B2 4/2004 Sussmeier
6,726,200 B2 4/2004 Gohl et al.
6,729,617 B1 5/2004 Chaume et al.
6,739,449 B2 5/2004 Mang et al.
6,820,873 B2 11/2004 Kulpa
7,025,347 B2 4/2006 Masui et al.
7,195,236 B2 * 3/2007 Hillerich, Jr. ..... B07C 1/025 271/149
7,431,292 B2 10/2008 Goto
7,467,792 B2 * 12/2008 Bittenbender ..... B65H 1/025 271/105
7,537,207 B2 5/2009 Kutzer et al.
7,537,212 B2 5/2009 Mitsuya et al.
7,552,918 B2 6/2009 Blackwell et al.
7,628,393 B2 12/2009 Mitsuya et al.
7,703,769 B2 4/2010 Schwarzbauer
7,712,735 B2 5/2010 Chorier-Pichon et al.
7,722,039 B2 5/2010 Shoji et al.
7,806,400 B2 10/2010 Fukusaka
7,815,184 B2 * 10/2010 Watanabe ..... B65H 3/124 271/100
7,832,721 B2 11/2010 Kutzer et al.
7,922,168 B2 4/2011 Schluenss
8,091,885 B2 1/2012 Conaway et al.
8,459,634 B2 6/2013 Asari et al.
8,960,661 B2 2/2015 Hugues
9,044,783 B2 6/2015 Brown et al.
9,056,738 B2 6/2015 Brown et al.
9,061,849 B2 6/2015 Brown et al.
9,340,377 B2 * 5/2016 Brown ..... B65H 1/025
9,943,883 B2 4/2018 Brown et al.
10,131,513 B2 * 11/2018 Brown ..... B65H 1/025
2002/0011703 A1 1/2002 Tomiyama et al.
2002/0153654 A1 10/2002 Blackwell et al.
2003/0141652 A1 7/2003 Guddanti et al.
2004/0193554 A1 9/2004 Hillerich, Jr. et al.
2004/0201161 A1 * 10/2004 Groegor ..... B65H 1/14 271/90
2005/0077217 A1 4/2005 Hillerich, Jr. et al.
2006/0053754 A1 3/2006 Carrigan et al.
2006/0087068 A1 4/2006 Bittenbender et al.
2007/0085259 A1 4/2007 Grogor et al.
2007/0252321 A1 11/2007 Kutzer et al.
2007/0296140 A1 12/2007 Babanats et al.
2008/0012202 A1 1/2008 Hubl et al.
2009/0028678 A1 1/2009 Kutzer
2009/0189332 A1 7/2009 Schwarzbauer et al.
2009/0206014 A1 8/2009 Enenkel
2009/0283963 A1 11/2009 Fee et al.
2010/0032889 A1 2/2010 Krause et al.
2010/0038840 A1 2/2010 Watanabe et al.
2010/0258407 A1 10/2010 Krause et al.
2010/0289205 A1 11/2010 Taki
2010/0329833 A1 12/2010 Ambroise et al.
2011/0116904 A1 5/2011 Stone et al.
2011/0129324 A1 6/2011 Philippe et al.
2011/0278785 A1 11/2011 Franzone et al.
2012/0013064 A1 1/2012 Samain et al.
2012/0013065 A1 1/2012 Ambroise et al.
2012/0153563 A1 6/2012 Schulze-Hagenest et al.
2012/0154795 A1 6/2012 Kobayashi
2012/0292845 A1 * 11/2012 De Ambrogio ..... B65H 1/025 271/10.01
2012/0299236 A1 * 11/2012 Fujita ..... B65H 1/14 271/96
2012/0319347 A1 12/2012 Moore
2014/0271087 A1 9/2014 Brown et al.
2014/0271088 A1 9/2014 Houston et al.
2014/0271090 A1 9/2014 Brown et al.
2014/0271091 A1 9/2014 Brown et al.
2014/0271098 A1 9/2014 Brown et al.

FOREIGN PATENT DOCUMENTS

EP 0 926 085 A1 6/1999
EP 1 531 137 A1 5/2005
EP 2 386 507 A1 11/2011

(56) References Cited

FOREIGN PATENT DOCUMENTS

| | | |
|---|---|---|
| JP | S 57-166244 | 10/1982 |
| JP | 60-56738 | 4/1985 |
| JP | H01-110446 | 4/1989 |
| JP | 01-288538 | 11/1989 |
| JP | H06-54649 | 7/1994 |
| JP | H07-53079 | 2/1995 |
| JP | 2000-85999 | 3/2000 |
| JP | 2000-109230 | 4/2000 |
| JP | 2001-300432 | 10/2001 |
| JP | 2002-068490 | 3/2002 |
| JP | 2003-136796 | 5/2003 |
| JP | 2003-171028 | 6/2003 |
| JP | 2011-104587 | 6/2011 |

OTHER PUBLICATIONS

International Search Report and Written Opinion dated Sep. 9, 2014 for International Application No. PCT/US14/23300.

* cited by examiner

SYSTEM AND METHOD OF AUTOMATIC FEEDER STACK MANAGEMENT

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57. This application is a continuation of and claims priority to U.S. application Ser. No. 15/154,603, filed May 13, 2016, which is a continuation of and claims priority to U.S. application Ser. No. 13/797,291, filed Mar. 12, 2013, now U.S. Pat. No. 9,340,377, the entire contents of which are hereby incorporated by reference.

BACKGROUND OF THE INVENTION

Field of the Invention

The disclosure relates to the field of automatic feeding and sorting of items. More specifically, the present disclosure relates to the automatic singulation of articles from a bulk stack of articles.

Description of the Related Art

Articles, such as items of mail, are frequently provided in bulk and must be sorted into individual articles or items for processing or routing. This sorting into individual items, or singulation, can be done automatically by placing a bulk stack of items or articles into a feeder. However, frequently, articles to be sorted are flimsy and must be supported while in the feeder. If the stack of articles in the feeder is not positioned correctly, or if it slumps, the singulation process may be slowed down or hampered with errors, such as picking more than one article at a time.

SUMMARY OF THE INVENTION

Some embodiments described herein relate to a system for managing articles in an automatic stack feeder comprising a frame configured to support a stack of articles; a perforated drive belt assembly comprising: a drive belt having an opening therein; a first end and a second end, wherein the first end of the perforated drive belt assembly is pivotably attached to the frame and the second end of the perforated drive belt assembly is pivotable about an axis of rotation defined by the attachment of the first end of the perforated drive belt assembly, and wherein the drive belt extends rotationally about the first and second ends; a conveyor connected to the frame and configured to move the stack of articles with respect to the drive belt; a sensor in proximity to the perforated drive belt assembly, the sensor configured to detect a force exerted on a portion of the perforated drive belt assembly by the stack of articles; and a controller configured to receive an input from the sensor and configured to control the conveyor based on the received input.

In some embodiments, the perforated drive belt assembly comprises a vacuum unit configured to apply a vacuum through the opening in the drive belt.

In some embodiments, the pivotable attachment of the perforated drive belt assembly comprises a spring configured to resist movement of the perforated drive belt assembly due to the force of the stack of articles.

In some embodiments, the sensor is configured to sense a pressure exerted on the perforated drive belt assembly by the stack of articles.

In some embodiments, the sensor is connected to the first end of the perforated drive belt assembly so as to sense the pressure exerted on the perforated drive belt assembly according to the movement of the second end of the perforated drive belt assembly about the axis of rotation defined by the attachment of the first end.

In some embodiments, the sensor is configured to sense angular displacement of the perforated drive assembly relative to the frame according to the force exerted by the stack of articles.

In some embodiments, the conveyor comprises a belt and a paddle, the belt and the paddle being independently moveable, and wherein the paddle is configured to provide vertical support for the stack of articles and the belt is configured to convey the stack of articles toward or away from the perforated drive belt assembly.

In some embodiments, the controller is configured to control adjustment of the position of the paddle or move the belt in response to the input received from the sensor.

In some embodiments, the system further comprises a photoelectric sensor located so as to detect an angle of the stack of articles relative to the frame.

In some embodiments, the controller is configured to receive an input from the photoelectric sensor.

Some embodiments disclosed herein relate to a method of automatic feeder stack management comprising placing one or more articles in contact with a conveyor; operating a drive belt assembly comprising a drive belt having an opening therein, wherein an end of the drive belt assembly is pivotably attached to the frame, and a free end of the drive belt assembly is rotatable bout an axis of rotation defined by the attached end; sensing a force exerted on the perforated drive assembly by the one or more articles; and controlling the position of the conveyor based on the sensed force, thereby controlling the position of the stack of articles.

In some embodiments, the method further comprises singulating an article from the one or more articles using a vacuum applied to the perforated drive belt assembly.

In some embodiments, the pivotable attachment of the perforated drive belt comprises a spring which resists movement of the perforated drive belt assembly due to the force exerted by the one or more articles.

In some embodiments, sensing a force comprises sensing the pressure exerted by the one or more articles on the perforated drive belt assembly.

In some embodiments, sensing the pressure exerted by the one or more articles on the perforated drive belt assembly comprises sensing the pressure exerted on the perforated drive belt assembly according to the movement of the perforated drive belt assembly about the axis of rotation defined by the attachment of the attached end.

In some embodiments, sensing a force comprises sensing an angular displacement of the free end of the perforated drive belt assembly in reference to the frame, according to the force exerted by the one or more articles.

In some embodiments, the conveyor comprises a belt and a paddle, which are independently moveable, and wherein the belt is configured to convey the one or more articles toward or away from the perforated drive belt assembly and wherein the paddle is configured to support the stack of articles.

In some embodiments, controlling the conveyor comprises moving at least one of the belt, or the paddle to adjust the position of the one or more articles relative to the perforated drive belt assembly.

In some embodiments, the system further comprises sensing an angle of the one or more articles relative to the frame using a photoelectric sensor.

In some embodiments, the system further comprises controlling the conveyor in response to the sensed angle of the one or more articles.

Some embodiments described herein relate to a system for singulating articles comprising a frame configured to support a stack of articles; a perforated drive belt assembly; means for sensing a pressure exerted on a portion of the perforated drive belt assembly by the stack of articles; means for conveying the stack of articles toward or away from the perforated drive belt assembly; and means for controlling the means for conveying the stack of articles based on input received from means for sensing the pressure.

In some embodiments, the perforated drive belt assembly comprises a means for providing a vacuum force which attracts a lead article in the stack of articles toward the perforated drive belt assembly.

BRIEF DESCRIPTION OF THE DRAWINGS

The foregoing and other features of the disclosure will become more fully apparent from the following description and appended claims, taken in conjunction with the accompanying drawings. Understanding that these drawings depict only several embodiments in accordance with the disclosure and are not to be considered limiting of its scope, the disclosure will be described with additional specificity and detail through use of the accompanying drawings.

DETAILED DESCRIPTION OF THE PREFERRED EMBODIMENT

Figure 1:
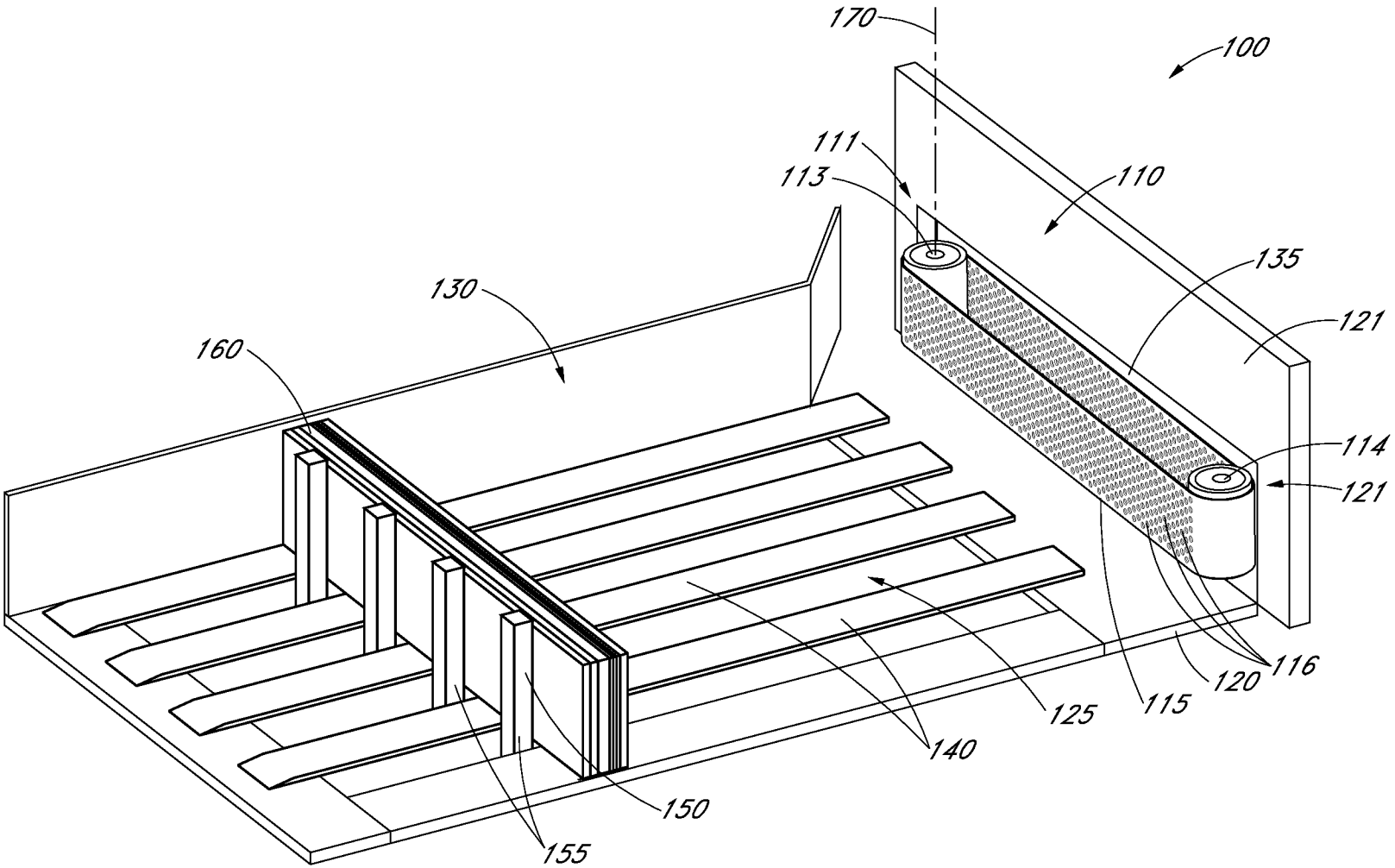
FIG. 1 is a perspective view of one embodiment of an automatic stack feeder.

In the following detailed description, reference is made to the accompanying drawings, which form a part hereof. In the drawings, similar symbols typically identify similar components, unless context dictates otherwise. Thus, in some embodiments, part numbers may be used for similar components in multiple figures, or part numbers may vary depending from figure to figure. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the Figures, can be arranged, substituted, combined, and designed in a wide variety of different configurations, all of which are explicitly contemplated and made part of this disclosure.

The system described herein provides for faster and more efficient separation or singulation of bulk articles, such as, for example, articles of mail. Articles of mail such as magazines and catalogs, which are too long in one direction to be considered a standard sized letter, are often called flats. Flats are often flexible and may sometimes be flimsy, which can cause problems in automatic stack feeders during singulation. These articles or flats may be processed as a stack. As used herein, the term stack may refer to a single article or to one or more articles grouped together, and may be used in an automatic stack feeder 100. Although the present disclosure describes systems and devices for sorting and/or singulating articles of mail, catalogs, and magazines, it will be apparent to one of skill in the art that the disclosure presented herein is not limited thereto. For example, the development described herein may have application in a variety of manufacturing, assembly, or sorting applications.

FIG. 1 depicts an embodiment of an automatic stack feeder 100. The automatic stack feeder 100 comprises a perforated drive belt assembly 110, a frame 120, and a conveyor 130. The frame 120 has a generally horizontal flat surface sized and is shaped to support a stack 160 of articles.

The frame 120 provides support for the perforated drive belt assembly 110 and the conveyor 130. Generally, the frame 120 is roughly table shaped, being elevated off the ground by a plurality of legs (not shown) or by other means known in the art. The frame 120 has a first end and a second end. The frame 120 comprises a vertical portion 121 attached at the first end of the frame 120. The vertical portion is mounted at a right angle to the generally flat horizontal surface of the frame 120. The vertical portion 121 may be formed with a void or hole 135 in which the perforated drive belt assembly 110 is disposed.

The perforated drive belt assembly 110 is located in proximity to the first end of the frame 120. The perforated drive belt assembly 110 may be attached directly to a flat surface at the first end of the frame 120. In some embodiments, the perforated drive belt assembly 110 may be disposed in close proximity to the first end of the frame 120 and within the vertical portion of the frame 120 such that the first end of the frame 120 is located near or in contact with the perforated drive belt assembly 110. The perforated drive belt assembly 110 may be disposed within the void or hole 135 in the vertical portion 121 such that a surface of the perforated drive belt 110 is aligned in the same plane as a surface of the vertical portion 121.

The major plane surface of the perforated drive belt assembly 110 is disposed generally vertically, at a right angle to the generally horizontal flat surface of the frame 120. The perforated drive belt assembly 110 comprises a first end 111, a second end 112, and a perforated drive belt 115. The first end 111 comprises a first spindle 113, and the second end 112 comprises a second spindle 114. The first spindle 113 and the second spindle 114 are connected to each other via connecting arms (not shown), which maintain a fixed distance between the first and second spindles 113 and 114, and allow for rotation of the first and second spindles 113 and 114 about vertical axes running through the center of first and second spindles 113 and 114, such as the axis 170 for the first spindle 113. The connecting arms and the first and second spindles 113 and 114 create a rigid form on which the perforated drive belt 115 is disposed.

The perforated drive belt 115 has perforations 116 disposed therein. As used herein, the term perforated drive belt may mean a drive belt having an opening or plurality of openings such that air flow is possible through the drive belt, while the perforated drive belt 115 maintains its structural integrity. In some embodiments, the perforated drive belt 115 has a plurality of small holes extending between the front and back surfaces, the holes being distributed generally uniformly over the surface of the perforated drive belt 115. In some embodiments, the perforated drive belt 115 may have one or more elongate holes arranged in lines parallel or perpendicular to the length of the perforated drive belt 115. In some embodiments the holes may have other suitable shapes. The holes may be concentrated in one region or area of the perforated drive belt 115 or may be uniformly distributed over the surface of the perforated drive belt 115.

The first end 111 of the perforated drive belt assembly 110 is pivotably attached to the frame 120 such that the first end 111 of the perforated drive belt assembly 110 pivots around an axis 170 as depicted. The second end 112 is not attached to the frame 120, but is connected to the first end via the connecting arms which connect the first and second spindles 113 and 114 together. As the first end 111 pivots around the axis 170, the second end 112 moves in an arc centered around the axis 170. The pivotable attachment mechanism of the first end 111 may comprise a spring or similar device which applies a restorative force which resists rotational motion about the axis 170. This resistance prevents free movement of the second end 112, and constrains the perforated drive belt assembly 110 to be in a predetermined orientation when no external forces are applied.

The perforated drive belt 115 is a continuous loop belt which is disposed on the external circumferential surfaces of the first spindle 113 and the second spindle 114. The first spindle 113 and the second spindle 114 are configured to rotate around axes running lengthwise through the center of first and second spindles 113 and 114. In some embodiments, the first spindle 113 is mechanically connected to a driving mechanism or motor (not shown) which rotates the first spindle 113. The perforated drive belt 115 is in contact with the external circumferential surfaces of the first spindle 113 and the second spindle 114 sufficient to cause the perforated drive belt 115 to move as the first spindle 113 is rotated by the driving mechanism or motor, thereby causing the perforated drive belt 115 to move. As the perforated drive belt 115 is moved by the first spindle 113, the movement of the perforated drive belt 115 also causes the second spindle 114 to move.

The frame 120 also comprises the structural support for the stack 160. The frame 120 provides a channel or area which can receive all or portions of the stack 160. The frame 120 also houses a conveyor 130. The conveyor 130 is configured to receive and deliver articles in the stack 160 to perforated drive belt assembly 100 for singulation.

The conveyor 130 comprises a belt 140 and a paddle 150. A surface of the belt 140 is disposed within the same plane as the generally horizontal flat surface of the frame 120. The belt 140 is a continuous loop disposed on rollers (not shown), located near the first and the second ends of the frame 120, the rollers being rotatably attached to frame 120. In some embodiments, the belt 140 may be a single belt. In some embodiments, the belt 140 comprises a plurality of smaller belts separated by a distance, which are generally aligned parallel to each other, as shown in FIG. 1. The smaller belts can be, for example, independently driven, or driven together. The rollers are attached to a motor and are configured to rotate, thus causing the belt 140 to move like a standard conveyor belt.

When the automatic stack feeder 100 is in operation, the stack 160 rests or sits on the belt 140. A weight sensor (not shown) may be attached to the frame 120 or to the belt 140 or its rollers. The weight sensor is disposed underneath the frame 120, and is attached to either the frame 120 or the rollers which operate the belt 140. The weight sensor is configured to sense the weight of the stack 160 on the frame 120 or on the belt 140. The weight sensor may be one of many weight sensors which are known in the art. For example, the weight sensor may be a scale, a load cell, a force sensor, a strain gauge, or any other known sensor capable to detecting a force or weight and output an electrical signal. The weight sensor may sense the weight or force applied to the frame 120 or to the rollers which are connected to the belt 140. The weight sensor may provide an indication of whether the stack 160 is present on the belt 140 or frame 120.

The paddle 150 is attached to a track or drive belt (not shown), which is attached to the frame 120. The track or drive belt is, in turn, attached to a motor. As the motor operates, the track or drive belt moves, which, in turn, moves the paddle 150. The motor and track are connected and configured to move the paddle 150 in a direction either toward or away from the perforated drive belt assembly 110. The paddle 150 is moveable along the length of the frame 120. The paddle 150 comprises one or more tines 155. The one or more tines 155 may comprise elongate members attached to a base of the paddle 150, the tines 155 extending away from the base of the paddle 150. The tines 155 are made of a rigid or semi-rigid material such as metal or plastic, sufficient to provide vertical support to the stack 160. As depicted, the paddle 150 may attach to the portion of the paddle 150 which is attached to the track is disposed below the surface of the frame 120. In some embodiments, the tines 155 are attached to the portion of the paddle 150 which is below the plane of the belt 140, and the tines 155 protrude through the spaces between or around the belt or belts 140. The frame 120 has voids or spaces in its surface in which the tines 155 are disposed, and within which the tines can move along the length of the frame 120 as the paddle 150 moves.

The paddle 150 is moveably attached to the track or drive belt such that the portion of the tines 155 extending above the surface of the frame 120 is variable. In some embodiments, the vertical position of the paddle 150 is adjustable. That is, the angle of the tines 155 in relation to the generally flat horizontal surface of the frame 120 is adjustable. The paddle 150 maintains the articles of the stack 160, particularly flats, in an orientation such that the article can make sufficient contact with the perforated drive belt 115 to be singulated.

The paddle 150 is configured to provide vertical support for the stack 160. The paddle 150 is moveable independent of the belt 140, and the belt 140 is moveable independent of the paddle 150. The belt 140 is configured to move the stack 160 either toward or away from the perforated drive belt assembly 110, as required. Generally, the belt 140 advances the stack 160 toward the perforated drive belt assembly 110 such that the lead article of the stack 160 impinges on the perforated drive belt 115 and is singulated.

The stack 160 may be made up of magazines, catalogs, mail, containers, tiles, boards, stackable components or materials, or other articles which are desired to be singulated; In some embodiments of the automatic static feeder 100, the stack 160 can be positioned such that some articles in the stack 160 are closer to the drive belt assembly 110 than other articles. The stack 160 comprises a leading article, which is the article in the stack 160 located closest to the perforated drive belt assembly 110.

As the stack 160 impinges on the perforated drive belt 115, the stack 160 applies a force to the perforated drive belt assembly 110. This force is resisted by a spring or similar device in the attachment of the first end 111. The spring or other resisting force may have a predetermined value which can be used in calculating a pressure exerted by the stack 160 on the perforated drive belt assembly 110 based on the displacement of the perforated drive belt assembly 110 from its position when no force is applied.

Singulation is accomplished as the stack 160, pushed or pulled along by the belt 140, the paddle 150, or both, moves toward the perforated drive belt assembly. The perforated drive belt 115 moves on spindles 113 and 114. The movement of the belt 140, the paddle 150, or both causes the stack 160 to move toward the perforated drive belt assembly. The leading article of the stack 160 thus impinges on the surface of the perforated drive belt 115. As will be described in greater detail below, when the lead article of the stack 160 impinges on the perforated drive belt assembly 115, the lead article is held to the surface of the perforated drive belt 115 by a vacuum force exerted on the leading article through the perforations in the perforated drive belt 115. The leading article of the stack, held against the perforated drive belt 115, is thus moved in the direction of movement of the perforated drive belt 115, thereby separating an individual article from the bulk the stack 160.

Figure 2:
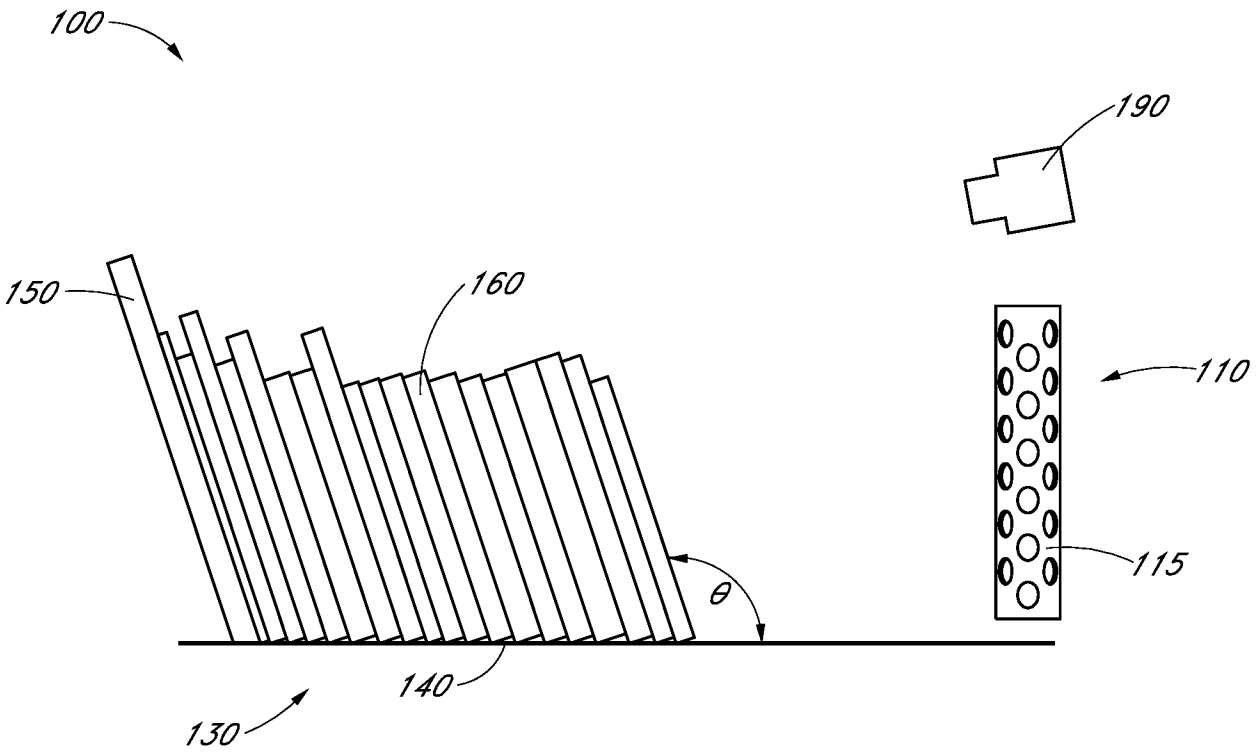
FIG. 2 is a side elevation view of one embodiment of an automatic stack feeder.

Referring to FIG. 2, the paddle 150 provides vertical support for the stack 160. For optimal singulation of the stack 160, an angle denoted as e, which is the angle between the plane of belt 140 and the articles in the stack 160 should be maintained in a desired range. In some embodiments, the angle e is maintained at less than 10 degrees variance from 90 degrees. In some embodiments, the angle e is maintained less than 100 degrees and greater than 90 degrees. The angle e can be adjusted by moving the paddle 150 either toward or away from the perforated drive belt assembly 110, while not moving the belt 140. Angle e can also be adjusted by moving the belt 140 either toward or away from perforated drive assembly 110 while not moving the paddle 150. Angle e may also be adjusted by moving the paddle 150 in a first direction and moving the belt 140 in a second direction, opposite to the direction in which the paddle 150 is moving.

In some embodiments, the paddle may maintain the stack 160 at an angle 8 which is slightly greater than 90°. However, if, for example, angle 8 is too much greater than 90 degrees, or, if the stack is leaning too far backward, as the leading edge of the leading article in the stack 160 is moved forward to contact the bottom of the perforated drive belt assembly 110, an insufficient portion of the surface of the leading article will make contact with the surface of the perforated drive belt 115, and singulation will be hindered. As the stack 160 presses on perforated drive belt assembly 110, the perforated drive belt assembly 110 resists movement. It should be noted that while the perforated drive belt assembly 110 resists movement, it does not resist movement entirely, and there may be a deflection of the second end 112 as the stack 160 impinges on the perforated drive belt 115.

The leading article and the other articles in the stack 160 can be brought into a more vertical position by speeding the advance of the paddle 150 or the belt 140 toward the perforated drive belt assembly 110. If the angle 8 is less than 90 degrees, or, if the stack 160 is leaning forward, as the leading edge of the leading article in the stack 160 is moved forward to contact the top of the perforated drive belt assembly 110, the perforated drive belt assembly 110 resists movement, and the leading article and the articles behind in the stack 160 can be brought into a more vertical position by accelerating the advance of or moving the paddle 150.

In some embodiments, when the stack is leaning to far back toward the paddle 150, or is slumping, the stack 160 can be brought into a more vertical position by maintaining the position of the paddle 150, and moving the belt 140 away from the perforated belt assembly 110. In some embodiments, the stack 160 may be brought into a more vertical position by accelerating the movement of the paddle 150 toward the perforated drive belt assembly 110 and slowing the movement of the belt 140 toward the perforated drive belt assembly 110. The mismatch of speed between the paddle 150 and belt 140 may reorient the articles in the stack 160 into the proper position. A similar method of changing the speed or direction of movement of the paddle 150 and the belt 140 relative to each other may be used to correct the stack 160 if it is leaning to far forward, or if the angle 8 is less than about 90°.

In some embodiments, the automatic stack feeder 100 has a photoelectric sensor 190. The photoelectric sensor 190 may be disposed in proximity to the frame 120 such that it has a view of the angle of the stack 160. In some embodiments, the photoelectric sensor 190 may be attached to the vertical portion 121 of the frame 120. The photoelectric sensor 190 is positioned and configured to sense the angle 8, or a similar corresponding or complementary angle indicative of the position of the stack 160 relative to the belt 140 or the frame 120. The angle of the stack detected by the photoelectric sensor 190 may be used as an input to control the automatic stack feeder 100, as will be described herein.

Figure 3A:
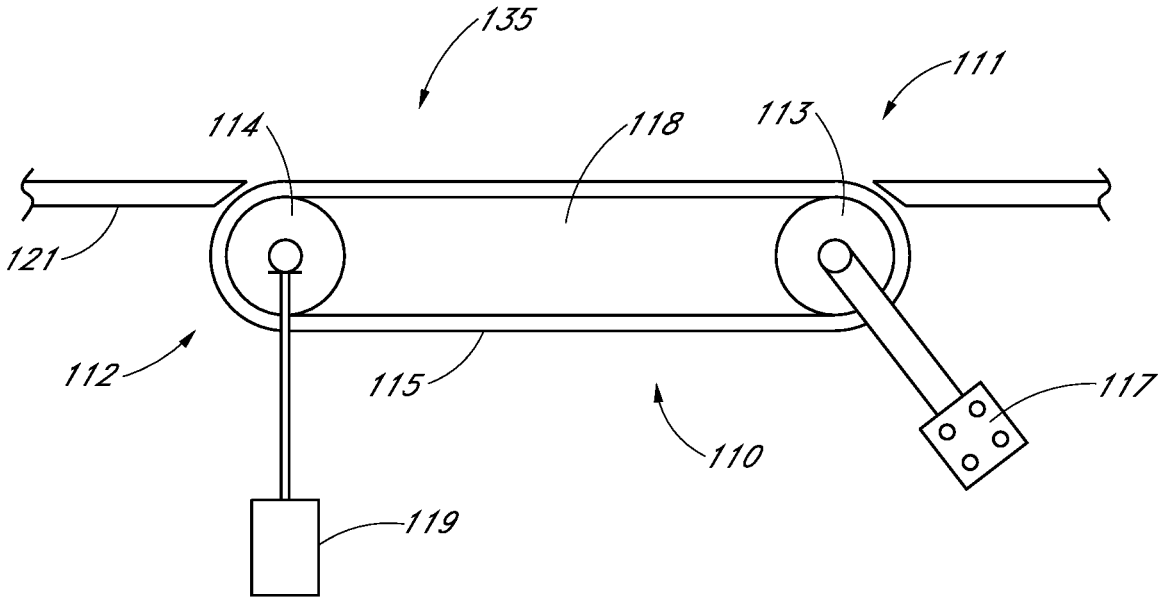
FIG. 3A is a top plan view of one embodiment of a perforated drive belt assembly in a first position.
Figure 3B:
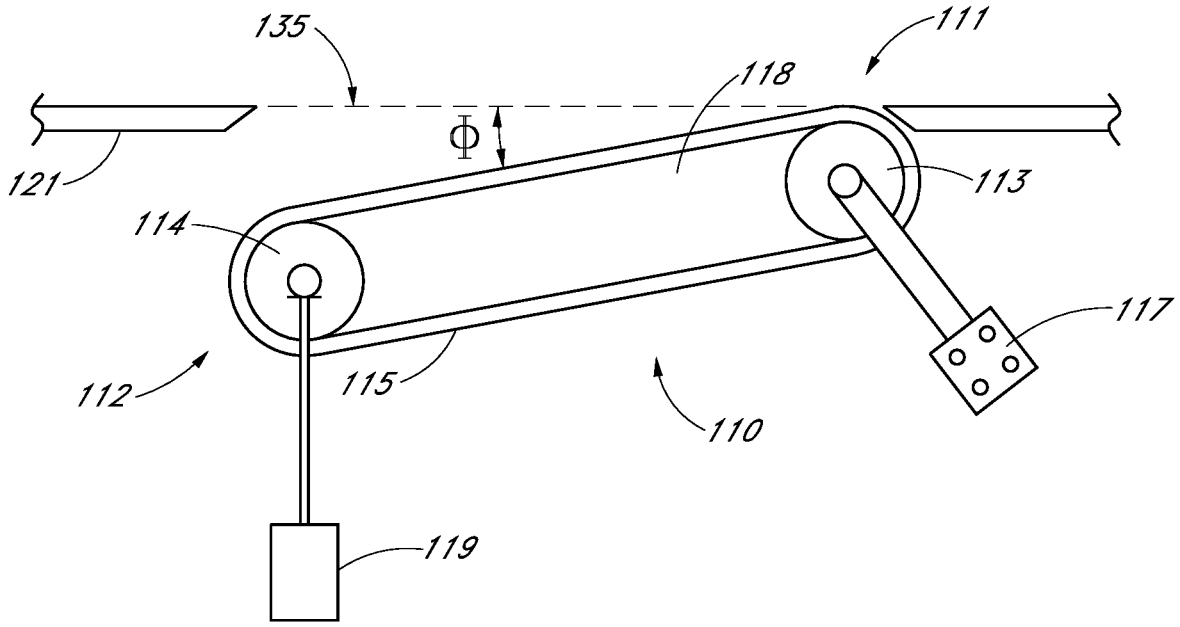
FIG. 3B depicts a top view of one embodiment of a perforated drive belt assembly in a second position.

Referring to FIGS. 3A and 3B, the frame 120 provides a surface which is in the plane of the surface of the perforated drive belt 115 which faces the stack 160. The vertical portion of the frame 120 includes a void or hole 135, located such that the bottom of the void or hole 135 is aligned with the generally flat horizontal surface of the frame 120. The void or hole 135 corresponds to the dimensions of the perforated drive belt assembly 110.

The perforated drive belt assembly 110 comprises a vacuum unit 118. The vacuum unit 118 is located between spindles 113 and 114, and is disposed such that the inner surface of the perforated drive belt 115 is capable of being in close proximity to, or is in direct contact with the vacuum unit 118. The vacuum unit 118 generates a vacuum which exerts a force directed toward the vacuum unit 118. The vacuum unit 118 provides a securing force upon the articles in the stack 160, and holding the adjacent surface of the article in the stack against the surface of the perforated drive belt 115 facilitates efficient singulation of the stack 160, as the surface of the article is held in sufficient contact with the perforated drive belt 115 to allow the vacuum force to hold the article against the perforated drive belt 115. More specifically, the vacuum unit 118 provides a vacuum force which is communicated through the perforated drive belt 115 via the perforations 116. The vacuum unit 118 develops a vacuum force which acts through the perforations in the perforated drive belt 115 to pull air, articles, or whatever is in range of the vacuum force toward the perforated drive belt 115.

As the stack 160 moves toward the perforated drive belt assembly 110 either by movement of the belt 140 or the paddle 150, or both, at least a portion of the leading article in the stack 160 nears or contacts the perforated drive belt 115. As the leading article of the stack 160 nears or contacts the perforated drive belt 115, the vacuum force generated by the vacuum unit 118 draws the leading article from the stack 160 and to the belt. The vacuum force acting through the perforations 116 holds the lead article flush against the outer surface of the perforated drive belt 115.

The perforated drive belt 115 moves in response to the rotation of spindles 113 and 114, and the article or flat which is held against the outer surface of the perforated drive belt 115 is thus separated from the stack 160, and is transported away from the stack 160. In some embodiments, the article is transported to a sorting machine or apparatus for further processing.

The perforated drive belt assembly 110 comprises a sensor 119. In some embodiments the sensor 119 is located in proximity to the perforated drive belt assembly 110. In some embodiments the sensor 119 is mechanically attached to the second end 112 via a depressible linkage which is attached to a top portion of spindle 114, as depicted in FIGS. 3A-3B. The sensor 119 is configured to sense a force exerted on the perforated drive belt assembly 110 by the stack 160. As the stack 160 impinges on the perforated drive belt 115, the second end 112 of the perforated drive belt assembly 110 may displace, which depresses the depressible linkage, as depicted in FIG. 3B, thereby generating a measurable force. In some embodiments, the sensor 119 may sense the displacement by using the depressible linkage in conjunction with a spring assembly. As the depressible linkage is depressed against a spring within the sensor 119, the depression of the depressible linkage is measured and the depression is translated to an electrical signal, corresponding to a pressure exerted on the perforated drive belt assembly 110 by the stack 160. Although one type of sensor is described here, a person of skill in the art will recognize that other types of sensors configured to sense a pressure or a force may be used in various configurations to accomplish the purpose of sensing the force exerted by the stack 160 on the perforated drive belt assembly 110.

For example, in some embodiments, the displacement may be sensed by a spring sensor 117, which is attached to the spindle 113 located in the first end 111 via a displacement spring (not shown). In this case, as the perforated drive belt assembly 110 displaces and rotates about the axis 170, the spring in the spring sensor 117 is compressed or expanded. The compression or expansion of this spring may be measured and electrically or electronically translated to a measure of pressure. In some embodiments, the displacement of the depressible linkage and/or the compression or expansion of the spring is not electrically translated to a pressure reading. For example, in some embodiments, an electronic signal related to the displacement of the perforated drive belt assembly 110 may be transmitted to the controller. In some embodiments, the perforated drive belt assembly 110 may have both the sensor 119 and the spring sensor 117. Having both the sensor 119 and the spring sensor 117 may provide a redundant pressure reading or sensor, or may increase the accuracy of the pressure or force measurements.

In some embodiments, the sensor 119 or the spring sensor 117 sense a change in angular position of the perforated drive belt assembly 110 relative to the frame 120, denoted as angle <p, rather than a pressure. In these embodiments, rather than generating a pressure signal, the sensor 119 and the spring sensor 117 generate an electrical signal which corresponds to the change in the angle <p. A person of skill in the art will understand that the same functionality can be provided by measuring either pressure or the angle <p. This functionality will be described later herein. Although FIGS. 3A-B depict the sensor 119 and/or the spring sensor 117 connected to the second end 112, it will be understood by those skilled in the art that the sensor 119 and/or the spring sensor 117 may be placed in various locations on the perforated drive assembly 110. For example, the sensor 119 and/or the spring sensor 117 may be attached to the first end 111, or to any position between the first end 111 and the second end 112. The sensor 119 and/or the spring sensor 117 is configured to output a sensed quantity, e.g., pressure, position, displacement, etc., for use in controlling the operation of the automatic stack feeder 100. The sensor 119 and/or the spring sensor 117 may be calibrated to output an appropriate or useable signal based on its position on the perforated drive belt assembly 110.

Figure 4:
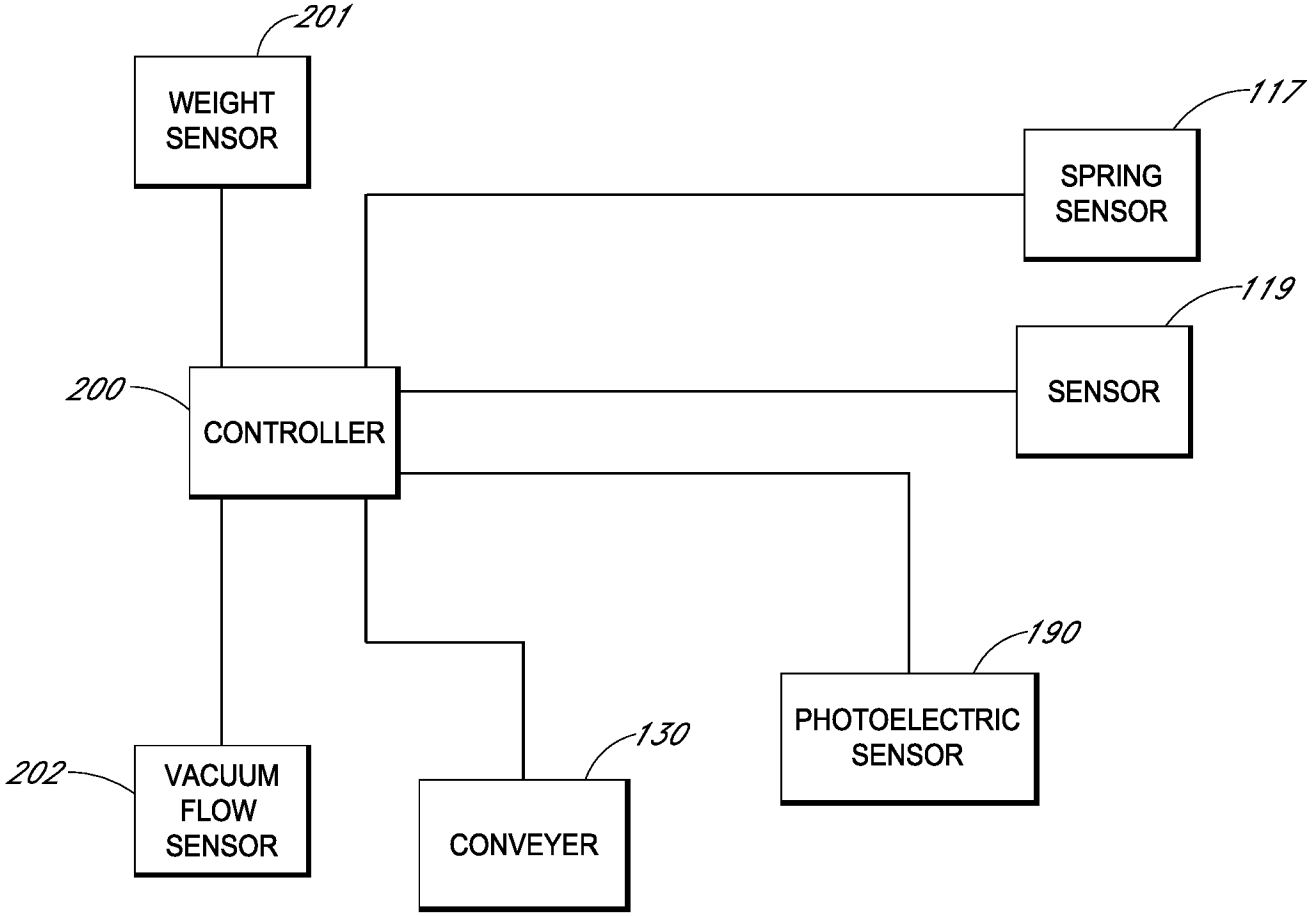
FIG. 4 is a schematic illustration of one embodiment of a controller for use in an automatic stack feeder.

FIG. 4 is a schematic diagram of one embodiment of a controller circuit of the automatic stack feeder 100. The controller 200 receives an input from the spring sensor 117 and/or the sensor 119. In some embodiments the controller 200 also receives an input from the photoelectric sensor 190. The input from the spring sensor 117 and/or the sensor 119 and/or the photoelectric sensor 190 is received and used to assess the condition of the stack 160 in the automatic stack feeder 100, and to develop control signals to the conveyor 130. The controller 200 may have a pre-loaded algorithm which determines how to adjust the position of the conveyor 130 according to a particular input from the sensor 119. Once the control signals are developed, the controller 200 can transmit the signals to the conveyor 130.

As described above, in some embodiments, the sensor 119 may be configured to sense the pressure exerted by the stack, 160 on the perforated drive belt assembly 110. The controller 200 may be configured to maintain the pressure exerted by the stack 160 on perforated drive belt 110 within a specified range. For example, as the pressure sensed by the sensor 119 increases, the controller 200 may slow down or stop the forward movement of the stack 160 by slowing or stopping either the movement of the belt 140 or the paddle 150, or both. Conversely, when the pressure sensed by the spring sensor 117 and/or the sensor 119 decreases below a set point, the controller 200 may speed up the movement of the stack 160 toward the perforated drive belt assembly 110, in order to maintain the pressure sensed by the spring sensor 117 and/or the sensor 119 within an optimal band.

The controller 200 may also receive input from the photoelectric sensor 190. The photoelectric sensor 190 determines the angle of the stack 160, and uses the angle as an input to the controller. In response to the input from the spring sensor 117, the sensor 119, and/or the photoelectric sensor 190, the controller 200 may generate signals to control the speed or direction of the belt 140. Additionally, the controller 200 may generate signals to control the movement or angle of the paddle 150.

The controller 200 may receive an input signal from the weight sensor 201 attached to the frame 120 or the belt 140. When the weight sensor 201 senses the weight of the stack 160 resting on the belt 140 or the frame 120, the weight sensor 201 sends a signal to the controller that the stack 160 is present and that the stack 160 has not been entirely singulated. When the weight sensor 201 does not sense the presence of the stack 160, the weight sensor 201 sends this signal to the controller 200. When the controller 200 receives the signal that there is no stack on the frame 120 or the belt 140 in the automatic stack feeder 100, then the controller 200 may send a signal to the belt 140, the paddle 150, or both to stop.

In some embodiments, the vacuum unit 118 comprises a vacuum sensor 202. The vacuum sensor 202 is positioned within the air stream created by the vacuum unit 118, and senses the speed, velocity, flowrate, or other suitable parameter of the air flowing through the perforations on the perforated drive belt 115 and into the vacuum unit 118. When vacuum sensor 202 senses that airflow is impeded or lessened, this may indicate that the lead article of the stack 160 is positioned flush with the perforated drive belt 115. When the vacuum sensor 202 senses airflow or speed is unimpeded or is at its maximum value, this may indicate that there are no articles being singulated, and that singulation has yet to commence, or that the stack 160 is entirely singulated.

The vacuum sensor 202 may provide an input to the controller 200. The controller 200 can use this input alone or in combination with the other signals it receives, to determine whether singulation is ongoing, or whether the stack 160 has been entirely singulated. With this information, the controller 200 can send appropriate control signals to operate the perforated drive belt assembly 110 and/or other system components.

Figure 5A:
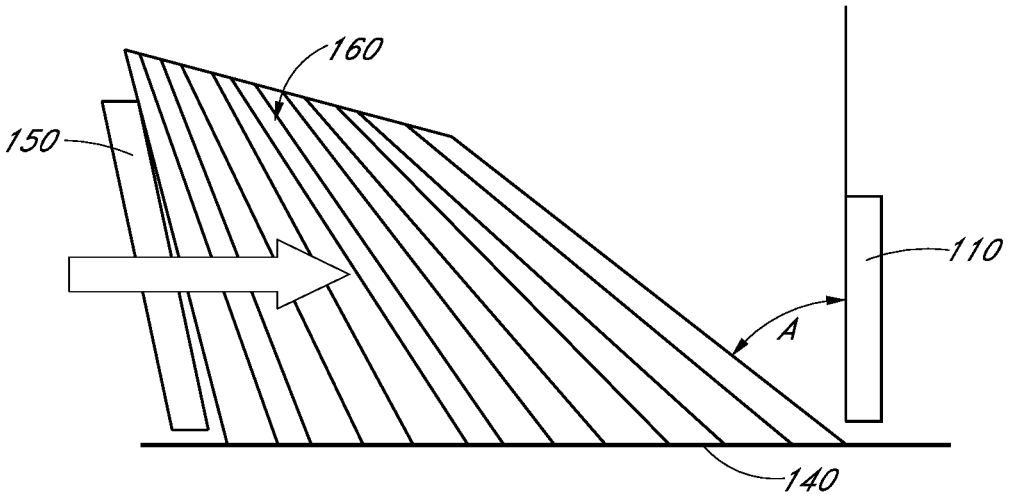
FIG. 5A is a side elevation view of a stack of articles in an automatic stack feeder.
Figure 5B:
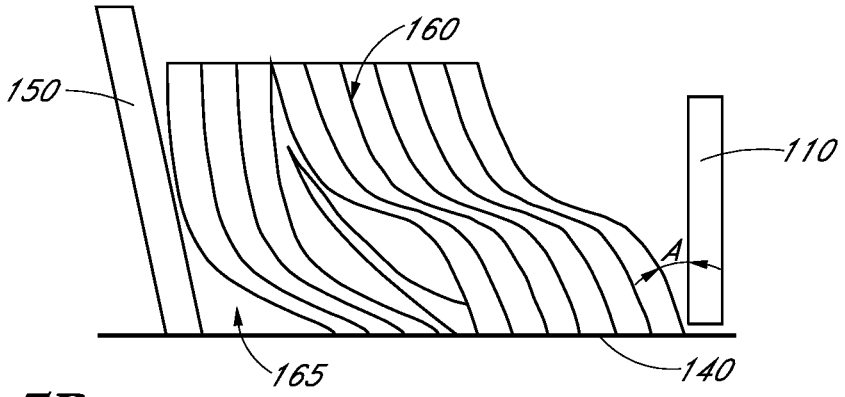
FIG. 5B is a side elevation view of a stack of articles exhibiting slump in an automatic stack feeder.
Figure 5C:
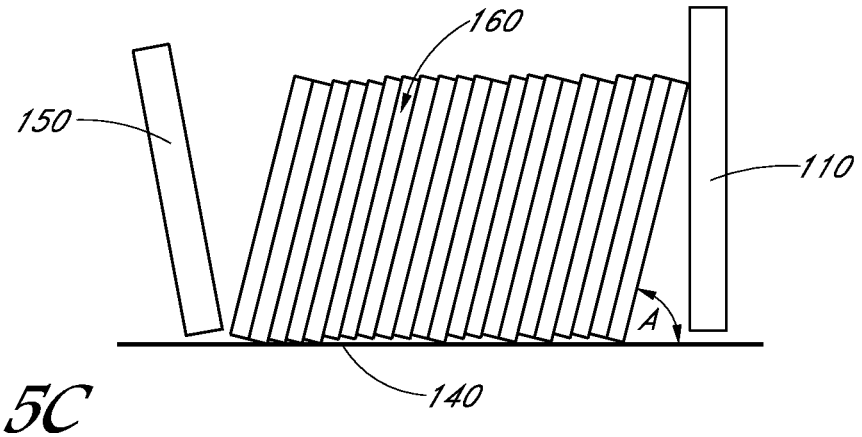
FIG. 5C is a side elevation view of a stack of articles leaning forward in an automatic stack feeder.

In an automated stack feeder 100, conditions may develop where the stack is not aligned for optimal singulation. Typically, the articles in the stack 160 are arranged such that the longer dimension of the article or flat is positioned generally parallel to the belt 140, and the shorter dimension is positioned generally perpendicular to the belt 140, and generally parallel to the perforated drive belt assembly 110. Some examples of non-alignment are illustrated in FIGS. 5A-5C. Referring to FIG. SA, the stack 160 comprises a stack of articles or flats. The stack 160 rests against the paddle 150, and sits on the belt 140. The belt 140 moves the stack 160 toward the perforated drive belt assembly 110 in the direction of the arrow. If the stack 160 fails to maintain sufficient pressure on the perforated drive belt assembly 110, or if the belt 140 or the paddle 150 are moving too slowly to keep up with singulation, the stack 160 may begin to slump. As the stack 160 slumps, the angle A may increase. As the angle A increases, it becomes increasingly difficult for an article to make sufficient contact with a surface of the perforated drive belt assembly 110. If an article cannot make sufficient contact with perforated drive belt assembly, the vacuum cannot attract and hold the leading article in the stack 160 to the perforated drive belt 115, and, therefore, singulation is hindered. This may result in misfeeds, improper singulation, or breakdown of the automatic stack feeder 100. Slump in the stack 160 may also result in damage to the articles of the stack 160. In some embodiments, the stack 160 may be slumping if the angle A is greater than 10° from vertical.

The stack slump illustrated in FIG. 5A can be detected by the spring sensor 117 and/or the sensor 119. When either the spring sensor 117 or the sensor 119 senses a pressure below a certain threshold acting on the perforated drive belt assembly, alone or in combination with a photoelectric sensor sensing the angle of the stack, the spring sensor 117, the sensor 119, and/or the photoelectric sensor 190 may transmit the detected pressure or angle of deflection to the controller 200. The set-point of the control system may be set to recognize that when a pressure is below a certain threshold, the belt 140, the paddle 150, or both must be advanced to correct a slumping stack. This correction is accomplished by controlled movement of one or both of the belt 140 ant he paddle 150 as was previously described in correcting the angle e.

FIG. 5B illustrates a second kind of slump that may occur in an automatic stack feeder. Where articles in the stack 160 are flimsy, they may bend and create voids 165 in the stack 160. Bent articles may not be able to make sufficient contact with the perforated drive belt assembly 110 such that vacuum force cannot hold the article to the perforated drive belt 115 in order to facilitate singulation. As described above, improper stack alignment may result in damage to the articles, misfeeds, improper singulation, or breakdown of the automatic stack feeder.

A slumping stack 160 having voids 160 may exert a pressure on the perforated drive belt assembly 110 outside the pre-set threshold pressure, as sensed by the spring sensor 117 and/or the sensor 119. The photoelectric sensor 190 may also be used to detect the slumping stack as depicted in FIG. 5B. As the stack slumps, the pressure is sensed on the perforated drive belt assembly 110 by the spring sensor 117 and/or the sensor 119, the pressure is transmitted to the controller 200, and the controller compares the transmitted pressures to internally stored or pre-set set-points or threshold values, established for proper operation for the automatic stack feeder 100. If the transmitted pressures are outside the threshold or set-point values, the controller 200 provides signals to move the belt 140, the paddle 160, or both, to straighten the slumping stack 160 for optimal singulation.

FIG. 5C depicts the stack 160 which is leaning forward, such that it is no longer being vertically supported by the paddle 150. In this case, too, singulation cannot be properly accomplished, since the leading article in the stack 160 does not make adequate surface contact with the perforated drive belt assembly 110 for the force generated by the vacuum unit 118 to effectively hold the article in contact with the perforated drive belt 115.

The stack 160 which is leaning forward may exert a pressure on the perforated drive belt assembly 110. The spring sensor 117 and/or the sensor 119 may sense the pressure exerted on an upper portion the perforated drive belt assembly 110 which is greater than a threshold pressure, indicating that the stack 160 is improperly positioned. The photoelectric sensor 190 may also sense that the stack is leaning forward, and may supply the stack angle signal indicating this condition to the controller 200.

When the spring sensor 117 and/or the sensor 119 detect a pressure higher or lower than a threshold pressure, the controller 200 may direct the belt 140, the paddle 150, or both to move to put the stack 160 back in its optimal configuration for singulation. In some embodiments, the controller receives the input from the spring sensor 117 and/or the sensor 119, and the photoelectric sensor 190, and uses these inputs to generate control signals to conveyor 130.

In some embodiments, the perforated drive belt assembly 110 may have two pressure sensors. One such sensor may be attached to the top portion of one of the spindles 113 and 114. A second sensor may be attached to the bottom portion of the same one of the spindles 113 and 114. In this arrangement, the pair of pressure sensors may be capable of detecting a differential pressure between the top and the bottom of the perforated drive belt assembly.

Where the stack 160 is leaning forward, the pressure exerted by the stack 160 may be exerted on a top portion of the perforated drive belt assembly. In this embodiment, as the stack 160 leans forward, the sensor attached to the top portion of one of the spindles 113 and 114 may sense a greater pressure than the sensor attached to the bottom portion of the same spindle 113 or 114. Thus, if the pressure exerted on the bottom of perforated belt were above a threshold value, the controller 200 could identify the problem and differentiate it from a case where the pressure exerted on the top of the perforated drive belt is above a threshold value. In these two cases of stack misalignment, different actions may be taken to correct the two different problems, such as those described above.

Although specific problems that may arise regarding the stack 160 have been described here, a person skilled in the art will recognize that the described problems are exemplary. Embodiments of the present disclosure may be configured to address stack misalignment issues in addition to those specifically described.

Figure 6:
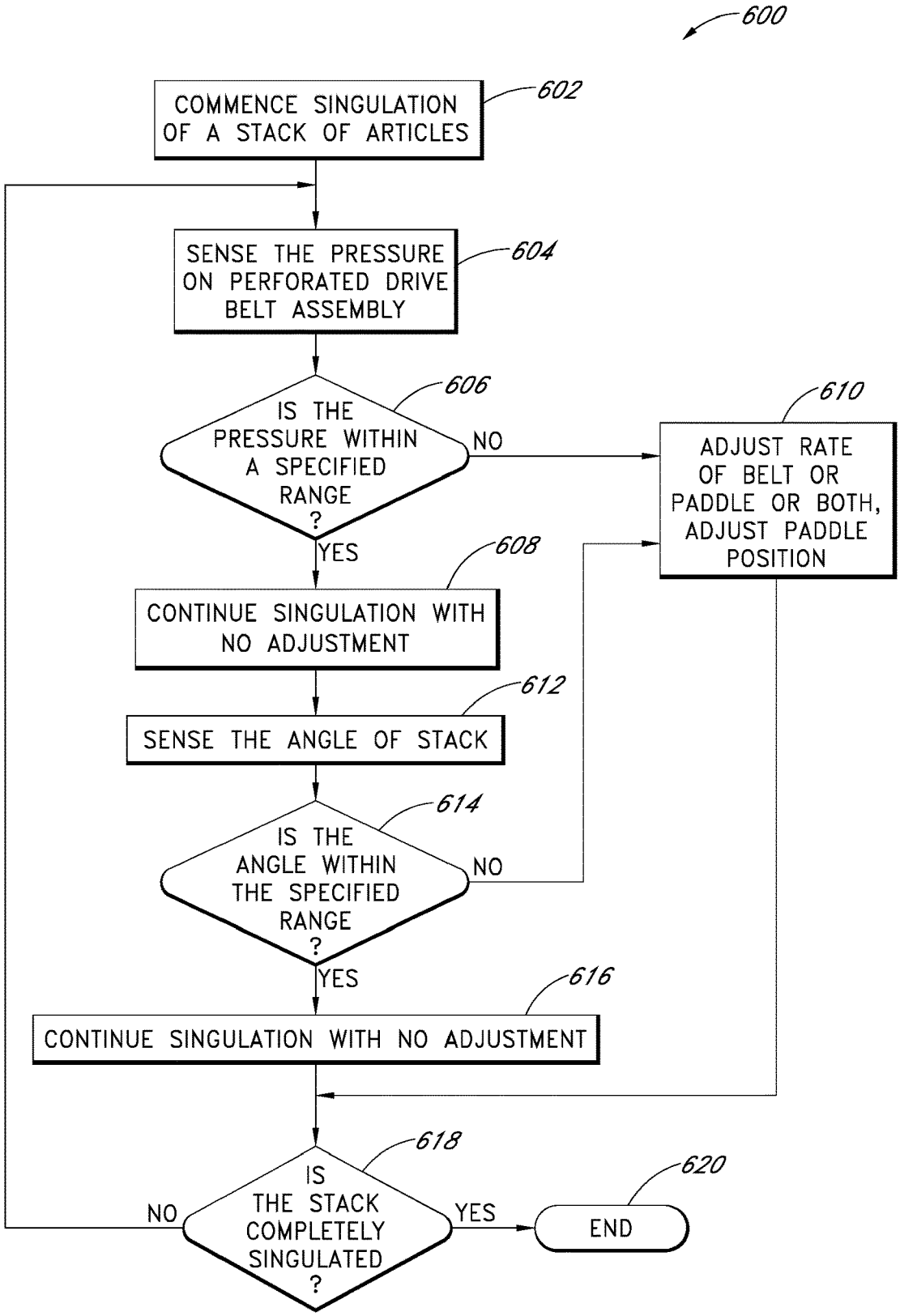
FIG. 6 is a flow chart depicting one embodiment of a method for controlling singulation in an automatic stack feeder.

FIG. 6 is a flowchart of an embodiment of a process 600 for controlling an automatic stack feeder. Process 600 may commence when the stack 160 of articles is placed in the automatic stack feeder 100. The process 600 proceeds to block 602 wherein singulation of the stack 160 of articles commences. Singulation, as described herein, uses a vacuum force to attract and hold an article to the perforated drive belt 115, which transports a single article along to a sorting process or other stage. During singulation the belt 140 and the paddle 150 may both move, independently or in concert, to advance the stack for singulation.

In block 604, the pressure exerted by the stack of articles on the perforated drive belt assembly is sensed. As described herein, the pressure may be sensed by the spring sensor 117 and/or the sensor 119 connected to the perforated drive belt assembly 110. The sensed pressure is transmitted to the controller 200. At decision block 606, it is determined whether the sensed pressure is either within a certain range or above or below a specified threshold. If the pressure is within the specified range and/or threshold, this may indicate that the stack is properly aligned, and that no adjustments are needed. If it is determined in decision state 606 that the sensed pressure is outside a specified range, or is above or below a given threshold, this may indicate a problem with the stack, its position, or with the singulation process.

If the answer to decision block 606 is no, then the process 600 proceeds to block 610 wherein the controller 200 produces signals causing adjustment of the position or speed of the paddle 150, the belt 140, or both, in order to correct the position of the stack 160. These adjustments may be similar to those described elsewhere herein. If the answer to decision block 606 is yes, then process 600 proceeds to block 608 where no adjustments are needed, and the belt and paddle continue their operations unchanged.

From block 608, the process 600 proceeds to block 612 wherein the photoelectric sensor 190 senses the angular position of the stack. The angular position is transmitted to the controller 200. The process 600 next proceeds to decision block 614 wherein it is determined whether the angle of the stack 160 is within the specified range or above or below a certain threshold. If the sensed angular position is not within the specified range or threshold, the process 600 proceeds from block 614 to block 610, and proceeds as indicated above.

If the sensed angular position is within the specified threshold, the process 600 proceeds from block 614 to block 616 wherein singulation of the stack continues without adjustment.

The process 600 proceeds from either block 610 or 616 to decision block 618 wherein it is determined whether the stack 160 is completely singulated. This determination may be accomplished in response to the weight sensor 201 sensing the weight of the stack 160 on the belt 140. Or the absence of the stack 160 may be determined by sensing whether the vacuum air flow is unobstructed by any articles using vacuum sensor. These ways described herein to sense whether the stack is completely singulated are only illustrative. A person of skill in the art will understand that there are other ways to sense whether the stack is completely singulated or not. For example, sensing whether the stack is completely singulated may be performed by an optical sensor, a timing circuit, a counter, or any other desired method.

If the stack 160 is not completely singulated, process 600 returns from block 618 to block 604, and the process repeats. This loop can continue until the stack 160 is entirely singulated, such that process 600 is able to control the rate and position of the belt and paddle continuously throughout the singulation process. Once the stack is completely singulated, and no articles remain, the process proceeds from block 618 to block 620 wherein the singulation process is terminated.

A person of skill in the art will recognize that process 600 need not be performed in the exact order specified. For example, the process may comprise sensing the angular position of the stack before sensing pressure. In some embodiments, the angular position of the stack may not be sensed at all.

The technology is operational with numerous other general purpose or special purpose computing system environments or configurations. Examples of well-known computing systems, environments, and/or configurations that may be suitable for use with the invention include, but are not limited to, personal computers, server computers, hand-held or laptop devices, multiprocessor systems, microprocessor-based systems, programmable consumer electronics, network PCs, minicomputers, mainframe computers, distributed computing environments that include any of the above systems or devices, and the like.

As used herein, instructions refer to computer-implemented steps for processing information in the system. Instructions can be implemented in software, firmware or hardware and include any type of programmed step undertaken by components of the system.

A microprocessor may be any conventional general purpose single- or multi-chip microprocessor such as a Pentium® processor, a Pentium® Pro processor, a 8051 processor, a MIPS® processor, a Power PC® processor, or an Alpha® processor. In addition, the microprocessor may be any conventional special purpose microprocessor such as a digital signal processor or a graphics processor. The microprocessor typically has conventional address lines, conventional data lines, and one or more conventional control lines.

The system may be used in connection with various operating systems such as Linux®, UNIX® or Microsoft Windows®.

The system control may be written m any conventional programming language such as C, C++, BASIC, Pascal, or Java, and ran under a conventional operating system. C, C++, BASIC, Pascal, Java, and FORTRAN are industry standard programming languages for which many commercial compilers can be used to create executable code. The system control may also be written using interpreted languages such as Perl, Python or Ruby. Those of skill will further recognize that the various illustrative logical blocks, modules, circuits and algorithm steps described in connection with the embodiments disclosed herein may be implemented as electronic hardware, software stored on a computer readable medium and executable by a processor, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such embodiment decisions should not be interpreted as causing a departure from the scope of the present invention.

The various illustrative logical blocks, modules, and circuits described in connection with the embodiments disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

If implemented in software, the functions may be stored on or transmitted over as one or more instructions or code on a computer-readable medium. The steps of a method or algorithm disclosed herein may be implemented in a processor-executable software module which may reside on a computer-readable medium. Computer-readable media includes both computer storage media and communication media including any medium that can be enabled to transfer a computer program from one place to another. A storage media may be any available media that may be accessed by a computer. By way of example, and not limitation, such computer-readable media may include RAM, ROM, EEPROM, CD-ROM or other optical disk storage, magnetic disk storage or other magnetic storage devices, or any other medium that may be used to store desired program code in the form of instructions or data structures and that may be accessed by a computer. Also, any connection can be properly termed a computer-readable medium. Disk and disc, as used herein, includes compact disc (CD), laser disc, optical disc, digital versatile disc (DVD), floppy disk, and Blu-ray disc where disks usually reproduce data magnetically, while discs reproduce data optically with lasers. Combinations of the above should also be included within the scope of computer-readable media. Additionally, the operations of a method or algorithm may reside as one or any combination or set of codes and instructions on a machine readable medium and computer-readable medium, which may be incorporated into a computer program product.

The foregoing description details certain embodiments of the systems, devices, and methods disclosed herein. It will be appreciated, however, that no matter how detailed the foregoing appears in text, the systems, devices, and methods can be practiced in many ways. As is also stated above, it should be noted that the use of particular terminology when describing certain features or aspects of the invention should not be taken to imply that the terminology is being redefined herein to be restricted to including any specific characteristics of the features or aspects of the technology with which that terminology is associated.

It will be appreciated by those skilled in the art that various modifications and changes may be made without departing from the scope of the described technology. Such modifications and changes are intended to fall within the scope of the embodiments. It will also be appreciated by those of skill in the art that parts included in one embodiment are interchangeable with other embodiments; one or more parts from a depicted embodiment can be included with other depicted embodiments in any combination. For example, any of the various components described herein and/or depicted in the Figures may be combined, interchanged or excluded from other embodiments.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims; or drawings, should be understood to contemplate the possibilities of including one of the terms, either of the terms, or both terms. For example, the phrase "A or B" will be understood to include the possibilities of "A" or "B" or "A and B."

All references cited herein are incorporated herein by reference in their entirety. To the extent publications and patents or patent applications incorporated by reference contradict the disclosure contained in the specification, the specification is intended to supersede and/or take precedence over any such contradictory material.

The term "comprising" as used herein is synonymous with "including," "containing," or "characterized by," and is inclusive or open-ended and does not exclude additional, unrecited elements or method steps.

All numbers expressing quantities of ingredients, reaction conditions, and so forth used in the specification and claims are to be understood as being modified in all instances by the term "about." Accordingly, unless indicated to the contrary, the numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should be construed in light of the number of significant digits and ordinary rounding approaches.

The above description discloses several methods and materials of the present invention. This invention is susceptible to modifications in the methods and materials, as well as alterations in the fabrication methods and equipment. Such modifications will become apparent to those skilled in the art from a consideration of this disclosure or practice of the invention disclosed herein. Consequently, it is not intended that this invention be limited to the specific embodiments disclosed herein, but that it cover all modifications and alternatives coming within the true scope and spirit of the invention as embodied in the attached claims.

What is claimed is:

1. A system for managing articles comprising:

a conveyor configured to support and move a stack of articles, the conveyor comprising a conveyor belt and a paddle, wherein the conveyor belt is configured to convey the stack of articles located thereon in a first direction or a second direction opposite the first direction, and wherein the paddle is configured to move in the first or in the second direction to provide support for the stack of articles located on the conveyor belt;

a perforated drive belt assembly connected to the frame, comprising:

a drive belt having an opening extending therethrough, and having an outer surface positioned proximate the conveyor and configured to be contacted by at least a portion of a lead article of the stack of articles;

a vacuum unit disposed proximate the drive belt and configured to provide a vacuum force which is communicated through the drive belt opening toward the vacuum unit; and a first sensor located proximate the drive belt and configured to sense a parameter of air flowing through the drive belt opening, to detect presence of an article in contact with the outer surface of the drive belt, and to generate a first signal related to the detected presence;

a second sensor configured to detect, independent of other sensors, an angle of a lead article in the stack of articles and to generate a signal related to the detected angle; and a controller in communication with the first and second sensors, the conveyor belt, the paddle and the drive belt, wherein the controller receives the signals from the sensors;

wherein the controller is configured to adjust the position, speed, or operating status of the conveyor belt, the paddle, the drive belt, or the vacuum unit in response to the received signals when the angle of the lead article in the stack of articles deviates from a threshold angle, and wherein the controller is configured to move the paddle in the second direction when the detected angle is less than the threshold angle.

2. The system of claim 1 wherein the controller is configured to move the paddle in the first direction when the detected angle is greater than the threshold angle.

3. The system of claim 1 wherein the controller is configured to move the conveyor belt in the second direction when the detected angle is greater than the threshold angle.

4. The system of claim 1, wherein the controller is configured to move the paddle in the first direction and move the conveyor belt in the second direction when the detected angle is greater than the threshold angle.

5. The system of claim 1, wherein the controller is configured to move the conveyor belt in the first direction at a first speed and to move the paddle in the first direction at a second speed which is greater than the first speed when the detected angle is greater than the threshold angle.

6. The system of claim 1 wherein the controller is configured to move the conveyor belt in the first direction when the detected angle is less than threshold angle.

7. The system of claim 1, wherein the controller is configured to move the paddle in the second direction and move the conveyor belt in the first direction when the detected angle is greater than the threshold angle.

8. The system of claim 1, wherein the controller is configured to move the conveyor belt in the first direction and to hold the paddle in place when the detected angle is greater than the threshold angle.

9. A method for managing articles comprising:

receiving a stack of articles onto a conveyor, the conveyor comprising a conveyor belt and a paddle, the conveyor belt configured to convey the stack of articles located thereon in a first direction toward an outer surface of a perforated drive belt assembly, or in a second direction opposite the first direction, the perforated drive belt assembly having a vacuum unit configured to cause airflow through an opening in the drive belt, the paddle being configured to provide support for the stack of articles located on the conveyor belt;

sensing, using a first sensor, a parameter of the airflow through the drive belt opening to detect a presence of an article on the outer surface of the drive belt;

generating a first signal related to the detected presence;

detecting, using a second sensor and independent of other sensors, an angle of a lead article in the stack of articles;

generating a second signal related to the detected angle;

receiving the first and second signals in a controller in communication with the conveyor belt, the paddle, the sensors and the drive belt; and adjusting the position, speed, or operating status of the conveyor belt, the paddle, the drive belt, or the vacuum unit in response to the received signals by adjusting the position or speed of the conveyor belt or the paddle when the angle of the lead article in the stack of articles deviates from a threshold angle, wherein adjusting the position or speed of the conveyor belt or the paddle comprises moving the paddle in the first direction when the detected angle is greater than the threshold angle.

10. The method of claim 9 wherein adjusting the position or speed of the conveyor belt comprises moving the conveyor belt in the second direction when the detected angle is greater than the threshold angle.

11. The method of claim 9, wherein adjusting the position or speed of the conveyor belt comprises moving the paddle in the first direction and moving the conveyor belt in the second direction when the detected angle is greater than the threshold angle.

12. The method of claim 9, wherein adjusting the position or speed of the conveyor belt comprises moving the conveyor belt in the first direction at a first speed and moving the paddle in the first direction at a second speed which is greater than the first speed when the detected angle is greater than the threshold angle.

13. The method of claim 9 wherein adjusting the position or speed of the conveyor belt comprises moving the paddle in the second direction when the detected angle is less than the threshold angle.

14. The method of claim 9 wherein adjusting the position or speed of the conveyor belt comprises moving the conveyor belt in the first direction when the detected angle is less than threshold angle.

15. The method of claim 9, wherein adjusting the position or speed of the conveyor belt comprises moving the paddle in the second direction and moving the conveyor belt in the first direction when the detected angle is less than the threshold angle.

16. The method of claim 9, wherein adjusting the position or speed of the conveyor belt comprises moving the conveyor belt in the first direction and holding the paddle in place when the detected angle is less than the threshold angle.

17. A method for managing articles comprising:

receiving a stack of articles onto a conveyor, the conveyor comprising a conveyor belt and a paddle, the conveyor belt configured to convey the stack of articles located thereon in a first direction toward an outer surface of a perforated drive belt assembly, or in a second direction opposite the first direction, the perforated drive belt assembly having a vacuum unit configured to cause airflow through an opening in the drive belt, the paddle being configured to provide support for the stack of articles located on the conveyor belt;

sensing, using a first sensor, a parameter of the airflow through the drive belt opening to detect a presence of an article on the outer surface of the drive belt;

generating a first signal related to the detected presence;

detecting, using a second sensor and independent of other sensors, an angle of a lead article in the stack of articles;

generating a second signal related to the detected angle;

receiving the first and second signals in a controller in communication with the conveyor belt, the paddle, the sensors and the drive belt; and adjusting the position, speed, or operating status of the conveyor belt, the paddle, the drive belt, or the vacuum unit in response to the received signals by moving the conveyor belt in the first direction and holding the paddle in place when the detected angle deviates from a threshold angle.

* * * * *